US005386613A

United States Patent [19]

Woo

[11] Patent Number: 5,386,613

[45] Date of Patent: Feb. 7, 1995

[54] WATER AND AIR SEPARATING MECHANISM

[75] Inventor: Han-Jin Woo, Suwon, Rep. of Korea

[73] Assignee: Samsung Electronics Co., Ltd., Suwon, Rep. of Korea

[21] Appl. No.: 979,767

[22] Filed: Nov. 20, 1992

[30] Foreign Application Priority Data

Nov. 25, 1991 [KR] Rep. of Korea ..... 91-21096

[51] Int. Cl.[6] ..... A47L 7/00

[52] U.S. Cl. ..... 15/326; 15/321; 15/353; 15/413

[58] Field of Search ..... 15/321, 322, 326, 413

[56] References Cited

U.S. PATENT DOCUMENTS

| | | | |
|---|---|---|---|
| 4,314,385 | 2/1982 | Wimsatt et al. | 15/321 |
| 4,356,591 | 11/1982 | Lude | 15/326 |
| 4,361,928 | 12/1982 | Schulz | 15/326 |
| 4,367,565 | 1/1983 | Parise | 15/321 |
| 4,433,451 | 2/1984 | Parisi | 15/321 |
| 4,665,581 | 5/1987 | Oberdorfer | 15/326 |
| 4,821,367 | 4/1989 | McAllister et al. | 15/353 |
| 4,910,828 | 3/1990 | Blase et al. | 15/353 X |
| 4,955,104 | 9/1990 | Miller | 15/321 X |

FOREIGN PATENT DOCUMENTS

| | | | |
|---|---|---|---|
| 3815320 | 11/1989 | Germany | 15/326 |

*Primary Examiner*—Chris K. Moore

*Attorney, Agent, or Firm*—Burns, Doane, Swecker & Mathis

[57] ABSTRACT

A water/air separating mechanism receives dirty water, and separates the air from the dirty water before discharging the air. The mechanism includes a housing in which there is disposed a motor which sucks the dirty water and air along a passage which includes an interruption located above a water chamber. The interruption includes a water outlet spaced horizontally from an air inlet. Water leaving the outlet gravitates into the water chamber, and the air travels to the air inlet. That air passes through the motor and then travels through a zig-zag passage before being discharged from the body. A floating valve in the water chamber is arranged to close the air inlet when the water reaches a certain level. A wave dissipation device in the chamber resists the creation of waves in the chamber.

4 Claims, 3 Drawing Sheets

WATER AND AIR SEPARATING MECHANISM

BACKGROUND OF THE INVENTION

1. Field of the Invention

The present invention relates to a wet and dry vacuum cleaner, more particularly, to a vacuum cleaner which can intake dust, dirt and the like using a wiping rag.

2. Description of the Prior Art

In general, such a vacuum cleaner has a suction generator driven by a driving means such as an electric motor which produces an absorption or suction force applied to remove dust, dirt or the like on an area to be cleaned. With an advanced technology of the field a wet and dry vacuum cleaner is commercially available in a market. Such a wet and dry vacuum cleaner is constructed such that water is supplied to an intake part of the cleaner so as to permit the area to be cleaned in a manner of wiping or scrubbing.

FIG.1 shows such a wet and dry vacuum cleaner. In the drawing, a suction generator driven by a driving means such as an electric motor is arranged in a cleaner body 1 to produce an absorption force. A water tank 3 containing dusting water W is disposed below the electric driver 2. A dirt collecting chamber 4 is provided at a lower side of the cleaner body 2 positioned below the water tank 3 so that the chamber 4 stores the dust and/or dirt inhaled by the absorption force of the electric suction generator. At a central portion of the interior of the water tank 3, a cylindrical structure 3*a* is defined and has a hollow column 1*a*. A floating member 5 is inserted in the hollow column 1*a* and moved upward or downward in accordance with the level of the dusting water contained together with the dust and/or filth in the dirt collecting chamber 4. That is, when the amount of the dust and/or dirt contained in the dirt collecting chamber 4 reaches a predetermined level, the floating member 5 strikes on the upper side of the column 1*a* or drives a sensing means (not shown) provided between the floating member 5 and the column 1*a* so as to signal the need for removing the dust and/or dirt contained in the chamber 4. An intake part 7 has a dustcloth member or rag 6 and is connected in communication with the interior of the dirt chamber 4 via a hose 8 emerging from a side of the dirt chamber 4. The hose 8 comprises an extended conduit 8*a*, a connection member 8*b* and an intake hose part 8*c*. Accordingly, the dust, dirt and/or polluted water inhaled through the intake part 7 is accommodated in the dirt collecting chamber 4 through the hose 8.

In a wiping mode of the cleaner, the water contained in the tank 3 is supplied to the rag 6 attached to the intake part 7 through a water supplying tube 9.

With the wet and dry vacuum cleaner thus constructed, however, since the floating member 5 is disposed on the same plane with the intaking position of the electric driver 2, the floating member 5 is moved upwardly due to the absorption force generated during the operation of the electric driver 3. As a result, it is difficult to correctly measure the level of dirt and polluted water contained in the dirt collecting chamber 4.

Further, since the dust, dirt and polluted water are stored together in the dirt collecting chamber 4, if the dirt collects on a sliding surface defined between the floating member 5 and the column 1*a*, then the sliding movement of the floating member 5B is likely to be affected by the inserted dirt and, therefore, it is necessary to clean the chamber 4 often.

Because the water tank 3 is located in the interior of the cleaner body 1, when there is little water sufficiently contained in the water tank 3, it cannot be easily supplied to the rag 6.

Also, noise is generated from the electric driver 5 and bad influence is thus affected to a user or other appliance in the vicinity of the area to be cleaned. Furthermore, an user feels tired due to serious vibration caused from the noises.

SUMMARY OF THE INVENTION

Accordingly, an object of the present invention is to provide a water/air separating mechanism in which dirt and polluted water can be separately stored to assure a floating member to be moved smoothly.

Another object of the present invention is to provide a water/air separating mechanism in which the level of the polluted dusting water sucked in and stored in a dirt collecting chamber can be correctly measured to indicate the timing of removing the polluted water correctly.

A further object of the present invention is to provide a water/air separating mechanism in which a water tank is disposed at an outer side of a cleaner body to easily supply water.

Still another object of the present invention is to provide a water/air separating mechanism which operates quietly.

To achieve the above objects, the present invention involves a water/air separating mechanism adapted for use in a wet and dry vacuum cleaner for separating dirty water from air. The mechanism comprises a housing having a main inlet for receiving a mixture of dirty water and air. A chamber is located in the housing for storing the dirty water. A suction generator, including a motor, is mounted in the housing for generating a suction. First and second passage portions disposed in the housing are arranged to connect the suction generator with the main inlet to draw dirty water and air into the housing. The first passage portion includes a water/air outlet disposed in the chamber for discharging dirty water and air into the chamber. The second passage portion includes an air inlet spaced horizontally from the water/air outlet to form therebetween an interruption defining a change in direction for the water/air mixture being conducted. The air inlet communicates with the suction generator so that the dirty water gravitates downwardly within the chamber, and the air enters the air inlet and is drawn to the suction generator. A filter is disposed within the housing for filtering dust from the air after the air enters the air inlet and before the air reaches the suction generator. A wave suppression member disposed in the chamber comprises a plate extending horizontally across the chamber and includes water passage openings, and at least one bar projecting downwardly from the plate.

DETAILED DESCRIPTION OF A PREFERRED EMBODIMENT OF THE INVENTION

Thereinafter, a preferred embodiment of the present invention will be described in detail.

Figure 1:
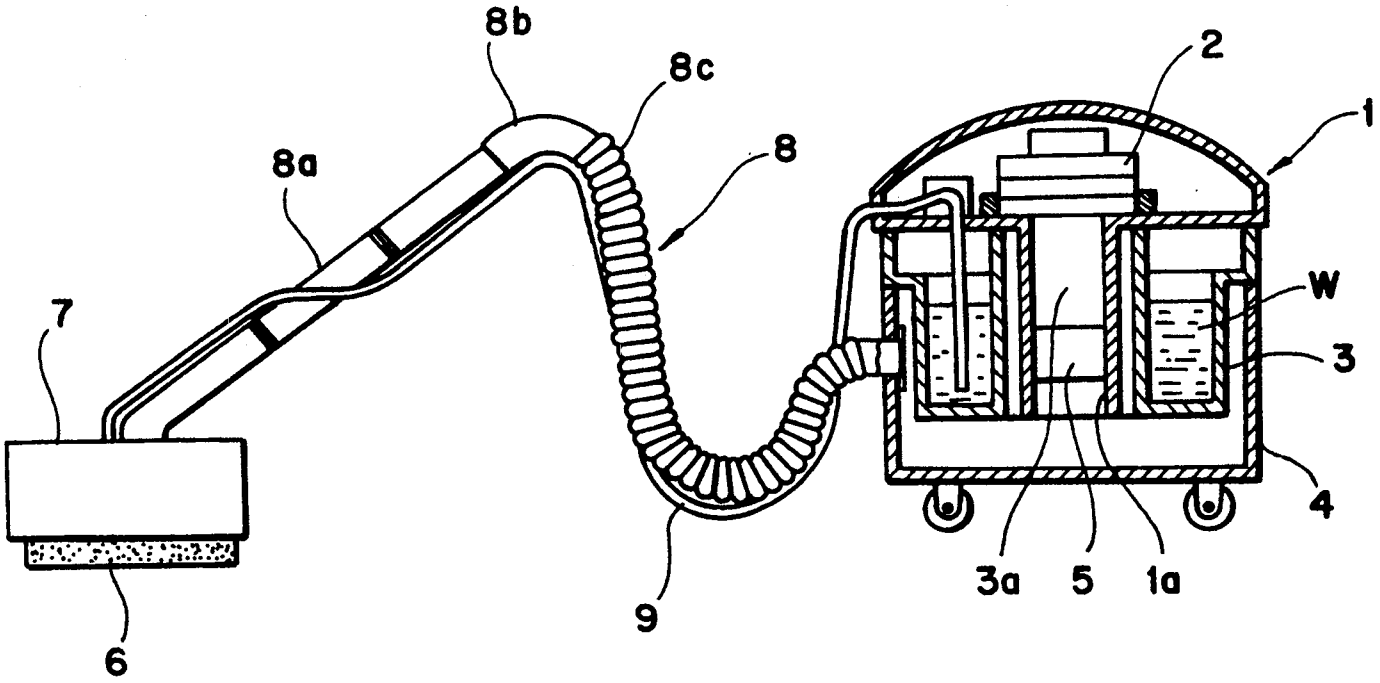
Fig. 1 PRIOR ART
FIG. 1 is a side view, in partially cut away, showing an internal construction of a conventional wet and dry vacuum cleaner.
Figure 2:
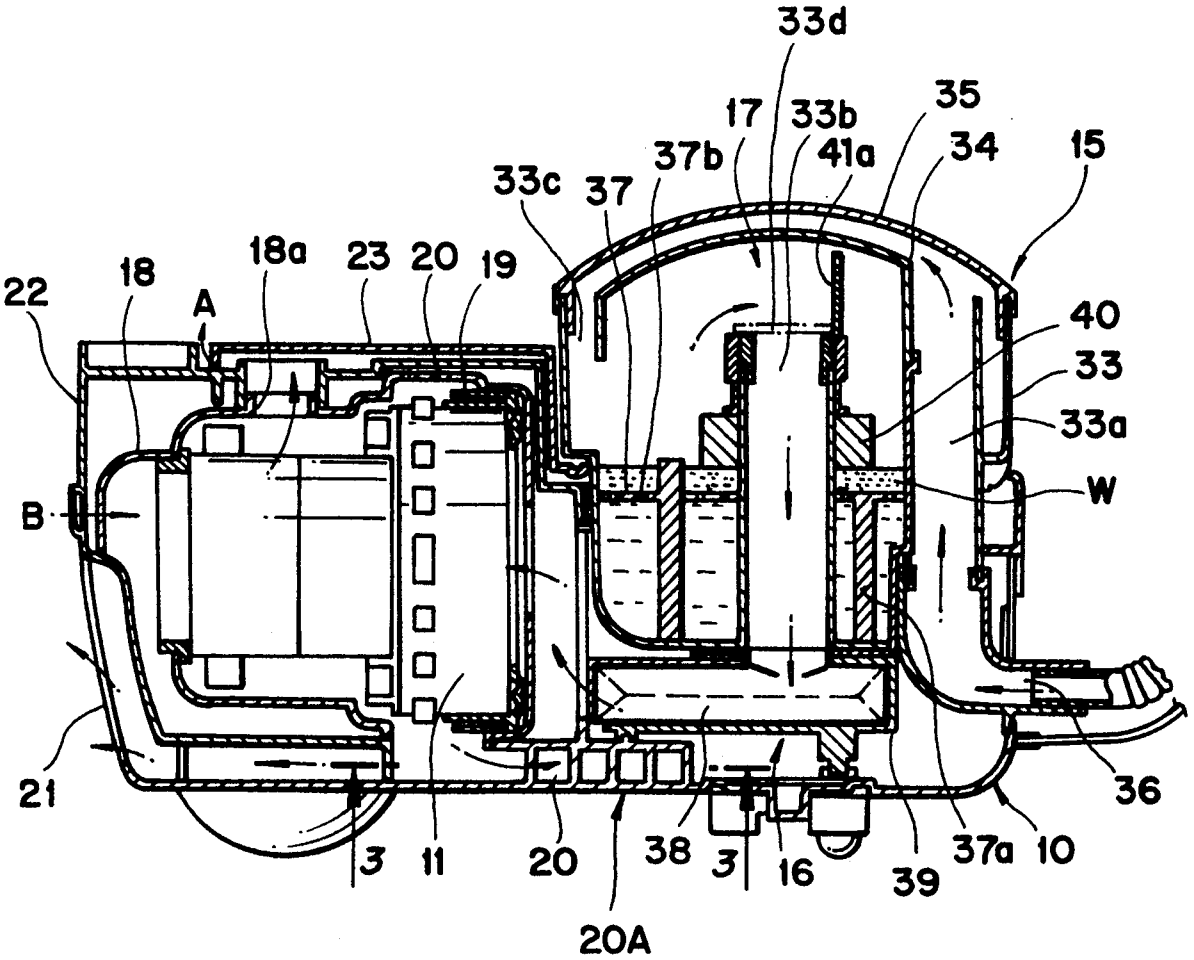
FIG. 2 is a side view similar to FIG. 1, but showing an internal construction of a preferred embodiment according to the present invention.

Referring to FIG. 2, there is disclosed a water/air separating mechanism adapted for use with a wet and dry vacuum cleaner (not shown). The separating mechanism includes a housing or body 10 in which there is disposed includes an electric driver 11 serving as a driving means of a suction generator which produces an absorption or suction force required to remove dust, dirt and the like from a place to be cleaned, a water supply portion and a dusting water supplying part 13 which supplies water to a cleaning head (not shown).

The vacuum cleaner further includes a dirt collecting part 15 which separately stores the dirt inflowed through a main inlet 36 of a cleaner body 10, a filter 16 which filters the dust particles contained in the dirt separated by the dirt collecting part 15, and an air intake control portion 17 which opens or closes according to the amount of the dirt stored in the dirt collecting part 15 to control the amount of the incoming air.

The electric driver 11 such as a motor is disposed in a housing 18 arranged at the internal side of the cleaner body 10 through a packing member 19 made of a plastic rubber or silicon rubber so as to reduce the noise and/or vibration occurring during the operation of the electric driver 11.

Figure 3:
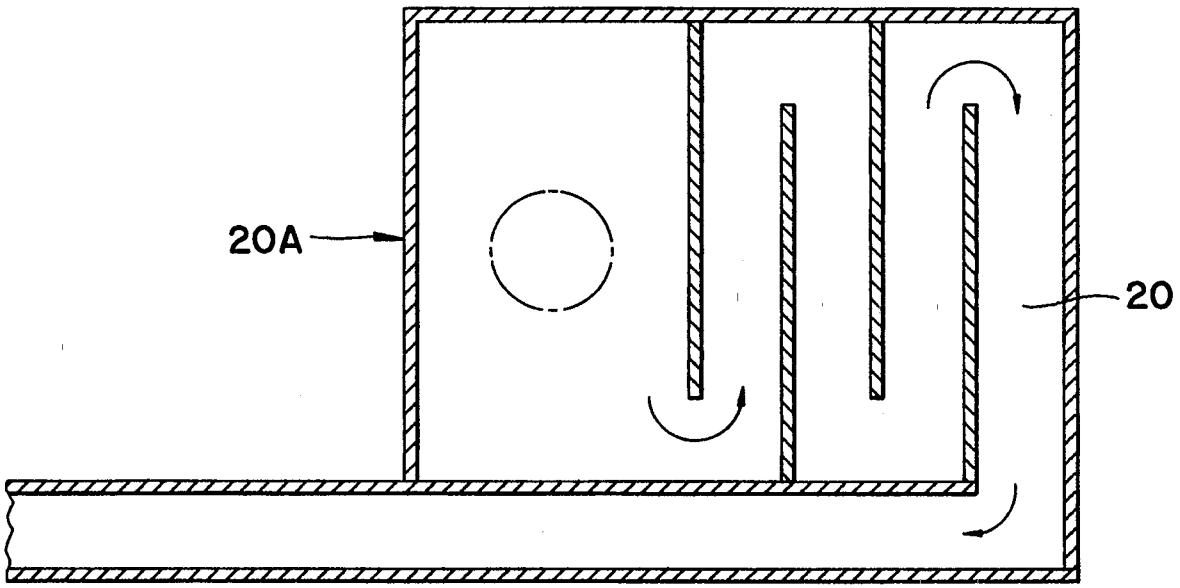
FIG. 3 is a sectional view taken along line 3—3 in FIG. 2.

At the lower side of the housing 18, a discharge path 20 of a zigzag structure 20A (see FIG. 3) is provided to discharge the air in order to further reduce the noise occurring due to the intake operation of the cleaner. The air passed through the path 20 can be discharged through an outlet 21 which is formed at a side of the path 20.

Meanwhile, at an upper side of the housing 18, there is provided an air exhausting aperture **18*a* through which separate external air is drawn and then discharged to remove the heat produced during the operation of the electric driver 11. A rear cover 22 and an upper cover 23 are connected to an upper portion of the air exhausting aperture 18*a*. The air heat-exchanged with the electric driver 11 and discharged through the air exhausting aperture 18*a* escapes through a passage defined between the rear cover 22 and the upper cover 23** (see the arrow A).

The water supply portion 13, which is disposed at a side of the extended conduit 26, includes a dusting water tank 28 which is detachably arranged thereto and contains water, and a water supplying pipe 29 through which the water contained in the dusting water tank 28 is supplied to a cleaning head.

The dirt collecting part 15, arranged at a rear portion of the interior of the cleaner body 10 having the electric driver 11 mounted therein, has a dirt storing chamber 33 which stores the dirt and polluted water W. The dirt collecting part 15 has also a guide cover 34 which is mounted on an upper opening formed in the interior of the dirt storing chamber 33 and a lid 35 which is spaced away from the guide cover 34 at a regular interval and serves to tightly close a top opening of the dirt storing chamber 33.

The dirt storing chamber 33 includes an intake passage **33*a* connected to the inlet 36. A wave preventing plate 37 is secured to the inside of the chamber 33 and functions to prevent the creation of a wave by the polluted water W incoming through a space defined between the upper surface of the guide chamber 34 and the lower surface of the lid 35, and an inflow path 33*b*. The latter conducts air separated from the dirt and polluted water W. It will be appreciated that the intake passage 33*a* constitutes a first passage portion having an outlet 33*c*, and the inflow path 33*b* constitutes a second passage portion having an inlet 33*d*. The outlet 33*c* and inlet 33*d* are horizontally separated at an upper portion of the chamber 33 so that water and dirt from the outlet 33*c* gravitates downwardly, while the air from the outlet 33*c* travels to the inlet 33*d***.

The wave preventing plate 37 has a plurality of guide bars **37*a* which are extended downwardly to prevent the polluted water W from forming waves, and has also a plurality of ventilating openings 37*b*** formed thereon.

A filter 16 is disposed at a lower portion of the inflow path **33*b*. The dirt storing chamber 33 has a filter box 38 for filtering dust particles contained in the air and a filter casing 39 formed on the cleaner body 10, the filter box 38 is detachably inserted into the filter casing 39**.

The air sucked through the air inflow path **33*b* and passed through the filter box 38 is exhausted outwardly through the discharge path 20 and the outlet 21 under the rotation of the electric driver 11**.

An incoming air control part 17 is arranged on the outer periphery surface of the inflow path **33*b* formed at the central portion of the dirt storing chamber 33 and includes a floating piece 40 ascending or descending in accordance with the level of the polluted water W and a valve member 41*a* for closing the tip end of the inflow path 33*b* by way of its own weight under the action of gravity when it gets to a predetermined position during the ascent of the floating piece 40**.

Now, the operation and effect of the water/air separating mechanism thus constructed will be described in detail. A mixture of dirty water and air entering the body 10 through the main inlet 36 is conducted along the first passage portion defined between the upper surface of the guide cover 34 and the bottom surface of the lid 35. After exiting the dirty water outlet **33*c*, the dirty water gravitates to the chamber 33, and the air enters the air inlet 33*d*. Accordingly, the dry dust particles are entrained in the air flow toward the filter 16 through the air inflow first passage portion 33*b***.

Preferably, according to the present invention, the electric driver 11 is accommodated in the housing 18 through the packing member 19 to thereby reduce the noise and vibration occurred during the drive of driving 11 considerably.

The creation of waves in dirt and polluted water W stored in the dirt storing chamber 33 can be prevented by way of the wave preventing plate 37 and the guide bars **37*a* vertically mounted to the wave preventing plate 37**.

Meanwhile, the dust or dirt entrained in the air sucked into the filter box 38 in the filter casing 39 of the filter 16 is filtered by filter box 38, and stored therein.

Accordingly, only the air purified by the filter 16 is passed through the filter box 38 and then exhausted from the outlet 21 along the air discharge path 20 after it has been passed through the suction generator in the housing 18.

When the filter box 38 is completely filled with the dust and/or dirt, the filter box 38 can be exchanged with a new one or the filter box 38 can be detached to remove the dust and/or dirt filled therein. The air exhausted is transferred through the discharge path 20 having a zigzag shape and exhausted from the outlet 21, so the noise can be reduced considerably.

Similarly, when the dirt and/or polluted water W has filled the dirt storing chamber 33, the floating piece 40 is ascended according to the increased level of the polluted dusting water W. Accordingly, the valve member 41 also ascends to a predetermined position and the valve 41*a* thus closes the top end of the second passage portion 33*b* by way of its own weight, so that no absorption force is further applied to the intake part 12.

The heat produced from the electric driver 11 in the cleaning is removed by the cooling air intaked from a side "B" of the housing 18 and the heat-exchanged air from the driver 11 is then outwardly discharged through the air exhausting aperture 18*a* in the housing 18 and the side of the upper cover 23 along a direction indicated by an arrow "A".

According to the wet and dry vacuum cleaner of the present invention as described above, the electric driver 11 is arranged in the housing 18 through the packing member 19 so as to decrease the noise and vibration of the cleaner, and the incoming air is discharged through the zigzag-shaped air discharge path 20 to further reduce the noise. The heat produced from the electric driver 11 is heat-exchanged with the external air inhaled through the side "B" of the housing 18. Therefore, the driver 11 can be driven suitably and silently.

The water and the dirt having relatively great specific gravity are separately stored in the dirt storing chamber 33. Accordingly, it assures the smooth movement of the floating piece 40 to indicate the level of the polluted water W. The need for exchanging or cleaning the dirt storing chamber 33 is informed to a user and the filter box 38 is detachably disposed in the filter case 39 to thereby allow the filter box 38 to be cleaned easily.

The valve member 41*a* is operated according to the floating piece 40 slidably moved on the basis of the level of the dirty water W and functions to indicate the timing to remove the polluted water W stored in the dirt.

What is claimed is:

1. A water/air separating mechanism for separating dirty water from air, comprising:

a housing having a main inlet for receiving a mixture of dirty water and air, said housing including a front end and an oppositely disposed rear end, said main inlet located adjacent said front end;

a chamber located in said housing for storing the dirty water;

a suction generator mounted in said housing for generating a suction and including a motor disposed adjacent said rear end of said housing, with said chamber disposed between said main inlet and said suction generator;

a first passage disposed in said housing for connecting said suction generator with said chamber to transmit suction to said chamber, said first passage including a vertical tube disposed in said chamber and defining an air inlet at its upper end;

a second passage disposed in said housing for connecting said chamber with said main inlet to transmit suction from said chamber to said main inlet which draws dirty water and air into said chamber, said second passage defining a water/air outlet in said chamber which is spaced horizontally from said air inlet to form an interruption between said first and second passages, whereby air emerging from said water/air outlet travels to said air inlet, and dirty water emerging from said water/air outlet gravitates downwardly within said chamber;

a filter disposed in said housing for filtering dust from the air after said air enters said air inlet and before said air reaches said motor;

noise damping packing disposed adjacent said motor for damping noise; and a wave suppression member disposed in said chamber comprising a plate extending horizontally across said chamber and including water passage openings, and at least one bar projecting downwardly from said plate.

2. The water/air separating mechanism according to claim 1 further including a valve member for closing said air inlet in response to a predetermined amount of dirty water being collected in said chamber.

3. The water/air separating mechanism according to claim 2, further including a float arranged to float on dirty water disposed in said chamber, said valve member mounted on said float and arranged to lean against a side of said tube when said float is disposed below a selected level, and to fall across and close said air inlet when said float is disposed above said selected level.

4. The water/air separating mechanism according to claim 1 further including flow terminating means for terminating the flow of air through said second passage in response to dirty water in said chamber reaching a predetermined height, said flow terminating means including a float arranged to float in dirty water stored in said chamber so as to rise in response to an increase in the height of the dirty water.

* * * * *